United States Patent [19]

Sakashita et al.

[11] 3,962,944

[45] June 15, 1976

[54] ELECTRONIC MUSICAL INSTRUMENT

[75] Inventors: Noriji Sakashita; Seiji Kameyama, both of Hamamatsu, Japan

[73] Assignee: Kabushiki Kaisha Kawai Gakki Seisakusho, Hammamatsu, Japan

[22] Filed: Feb. 12, 1975

[21] Appl. No.: 549,459

[30] Foreign Application Priority Data

Feb. 13, 1974 Japan ..... 49-17938

[52] U.S. Cl. ..... 84/1.01; 84/DIG. 11

[51] Int. Cl.[2] ..... G10H 5/06

[58] Field of Search ..... 84/1.01, 1.23, 1.24, 84/1.25, DIG. 11, 1.03, 1.22

[56] References Cited

UNITED STATES PATENTS

| | | | |
|---|---|---|---|
| 3,236,931 | 2/1966 | Freeman | 84/1.23 |
| 3,821,714 | 6/1974 | Tomisawa et al. | 84/1.01 X |

*Primary Examiner*—L. T. Hix
*Assistant Examiner*—Stanley J. Witkowski
*Attorney, Agent, or Firm*—Haseltine, Lake & Waters

[57] ABSTRACT

An electronic musical instrument in which a plurality of order pulse generators and musical-tone waveform forming circuits are connected in order to a tone-source-signal pulse generator. A first pulse-counter circuit and a second pulse-counter circuit are provided in each of the circuits diverging from the output terminal of the tone-source-signal pulse generator to the respective order pulse generators, so that the output signal of the tone-source-signal pulse generator is frequency-divided by the first pulse-counter circuit into $1/x$ and is then applied as an input signal to the order pulse generator, while the output signal of the tone-source-signal generator is frequency-divided by the second pulse-counter circuit into $1/n$ and is then applied as a reset pulse to both the first pulse-counter circuit and the order pulse generator. The numbers x and n are integral numbers with the relation $0<x<n$. Each musical-tone waveform forming circuit has a sampling number of from 10 to 40.

4 Claims, 4 Drawing Figures

ELECTRONIC MUSICAL INSTRUMENT

FIELD OF THE INVENTION

This invention relates to electronic musical instruments.

BACKGROUND OF THE INVENTION

There has recently been developed a type of electronic musical instrument which is an arrangement in which a plurality of order pulse generators and a plurality of musical-tone waveform forming circuits are connected in order to the output side of a tone-source-signal pulse generator. The order pulse generators each comprises an address counter, which is composed of a plurality of one-half frequency-dividers connected in series so that a plurality of frequency-divided pulses can be generated from the output terminals of these frequency-dividers. Also included is a matrix circuit, which operates in such a manner that the frequency-divided pulses are decoded thereby and a plurality of order pulses can be taken out in order from the output terminals thereof. The musical-tone waveform forming circuits each comprises a musical-tone-waveform memory circuit which has a sampling number (that is, the set values previously memorized are read out by the order pulses and are converted into digital signals constituting output signals) corresponding to the number of previously mentioned order pulses from 1 to $n$, and a digital-to-analog converter which operates in such a manner that the digital signals obtained in order therefrom are converted into analog signals to form a musical-tone signal.

If, for example, the pulse oscillation frequency of the tone-source-signal pulse generator is f, the output signal thereof (that is, a series of pulses) is decoded by each order pulse generator and converted into order pulses of from 1 to $n$, and one musical-tone waveform is formed from the order pulses of from 1 to $n$ by each tone waveform forming circuit and thus a musical-tone signal of frequency $f/n$ can be obtained. The above is disclosed, for example, in U.S. Pat. No. 3,515,792.

With this arrangement, for obtaining musical-tone signals extending over a wide octave range, the oscillation frequency f of the tone-source-signal pulse generator 1a must be set very high such as, for example, at 2.00024 MHz and the number of order pulses $n$ at each of the order pulse generators must be set, for example, at 239, 253, . . . 451, 478 . . . etc. The fact that the number $n$ must be varied as above results in disadvantages including that the respective sampling numbers of the musical-tone waveform memory circuits of the musical-tone waveform forming circuits must be differentiated from one another and that these must be numerous. Thus, the manufacture and adjustment thereof is relatively troublesome.

SUMMARY OF THE INVENTION

This invention has as an object the provision of an electronic musical instrument free from the above-mentioned defects.

According to the invention, an electronic musical instrument, of the type in which a plurality of order pulse generators and musical-tone waveform forming circuits are connected in order to a tone-source-signal pulse generator, is characterized in that a first pulse-counter circuit and a second pulse-counter circuit are provided in each of the circuits diverging from the output terminal of the tone-source-signal pulse generator to respective order pulse generators, so that the output signal of the tone-source-signal pulse generator is frequency-divided by the first pulse-counter circuit into $1/x$ and is applied as an input signal to the order pulse generator, while the same output signal is frequency-divided into $1/n$ and is applied as a reset pulse to both the first pulse-counter circuit and the order pulse generator.

Further in accordance with the invention, it is generally conceived that an electronic musical instrument is provided which comprises a plurality of musical-tone-waveform generating means for generating musical tones, a plurality of order pulse generating means for generating order pulses to sample respective of the musical-tone-waveform generating means, tone-source-signal generating means for generating a tone-source-signal, and a plurality of counting means coupling said musical-tone-waveform generating means to respective of said order pulse generating means for dividing the frequency of said tone-source-signal, said counting means including count modifying means to provide for precise tone generation.

According to a feature of the invention, each said counting means includes first and second pulse counters each coupled to said tone-source-signal generating means, said first counter being coupled to and supplying count signals to the associated order pulse generating means, said second counter being coupled to and adapted to reset said first counter.

According to another feature of the invention, said order pulse generating means includes an address counter and matrix coupled in series to the associated musical-tone-waveform generating means at the second counter of the associated counting means is connected to and adapted to reset said address counter.

According to another feature of the invention, the first and second pulse counters respectively divide the tone-source-signal by $1/x$ and $1/n$ with the relation of $O<x<n$, with $x$ and $n$ being integral numbers.

According to a further feature of the invention, each said musical-tone-waveform generating means has a sampling number of 10 to 40.

DETAILED DESCRIPTION OF THE DRAWINGS

Figure 1:
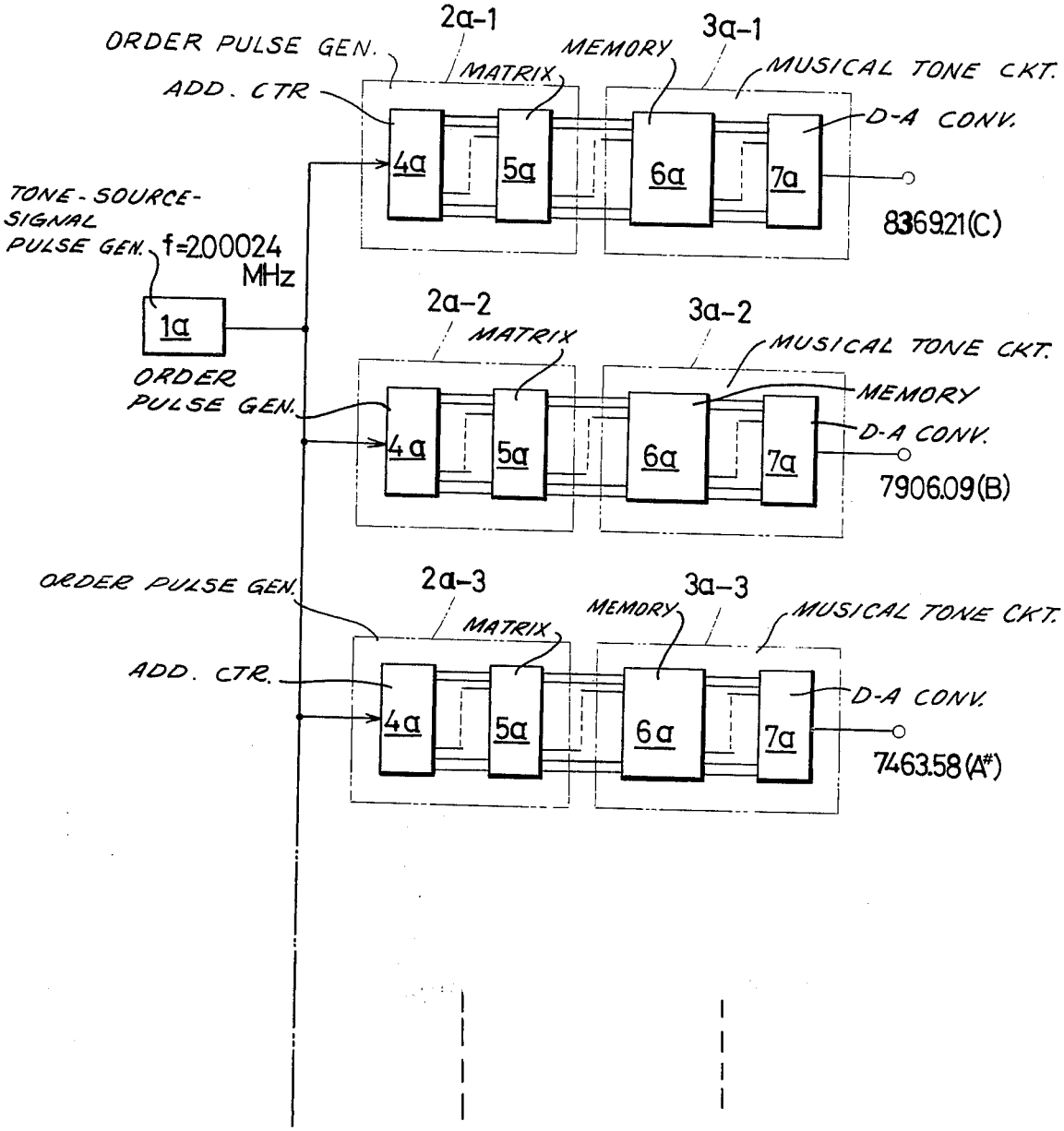
Fig. 1 PRIOR ART
FIG. 1 is a block diagram showing a prior art example of a conventional electronic musical instrument.

As has been indicated above, there was previously developed a type of electronic musical instrument upon which the present invention is intended to constitute an improvement. With reference to FIG. 1, it can be seen that there is provided an arrangement in which a plurality of order pulse generators 2*a*-1, 2*a*-2 . . . 2*a*-*n* and a plurality of musical-tone waveform forming circuits 3*a*-1, 3*a*-2 . . . 3a-*n* are connected in order to the output side of a tone-source-signal pulse generator 1a. The order pulse generators 2*a*-1, 2*a*-2 . . . 2*a*-n each comprise an address counter 4a which is composed of a plurality of one-half frequency-dividers connected in series so that a plurality of frequency-divider pulses such as shown at 1', 2' and 3' of FIG. 2(A) can be generated from the out-put terminals of these frequency-dividers.

Figure 2:
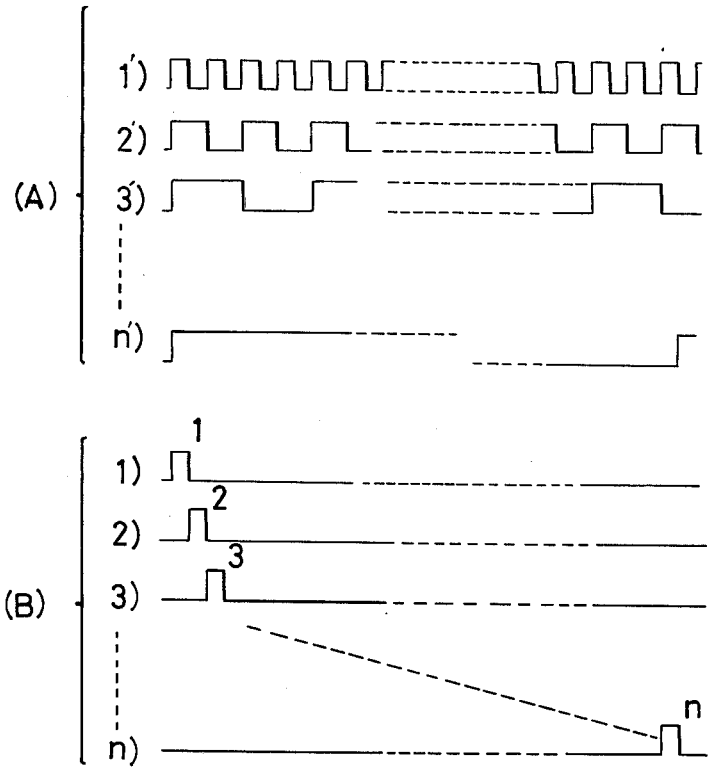
FIG. 2 is a diagram for explaining the operation of the instrument of FIG. 1.

Also included is a matrix circuit 5*a* which operates in such a manner that the frequency-divided pulses are decoded thereby and a plurality of order pulses such as shown at 1, 2 and 3 of FIG. 2(B) can be taken out in order from the output terminals thereof. The musical-tone waveform forming circuits 3*a*-1, 3*a*-2 . . . 3*a*-*n* each comprises a musical-tone-waveform memory circuit 6a which has a sampling number corresponding to the number of previously mentioned pulses from 1 to n and a digital-to-analog converter 7a which operates in such a manner that the digital signals obtained in order therefrom are converted into analog signals to form a musical-tone signal.

If, for example, the pulse oscillation frequency of the tone-source-signal pulse generator 1*a* is f, the output signal thereof is decoded by each order pulse generator 2*a*-1, 2*a*-2 . . . 2*a*-n and converted into order pulses of from 1 to n, and one musical-tone waveform is formed from the order pulses of from 1 to *n* by each tone-waveform forming circuit 3*a*-1, 3*a*-2 . . . 3*a*-n. Thus, a musical-tone signal of frequency f/n can be obtained. As noted above, the foregoing is disclosed by way of example in U.S. Pat. No. 3,515,792.

With this arrangement for obtaining musical-tone signals extending over a wide octave range, the oscillation frequency f of the tone-source-signal pulse generator 1a must be set very high, such as, for example, at 2.00024 MHz and the number of order pulses n at each of the order pulse generators 2*a*-1, 2*a*-2 . . . 2*a*-n must be set, for example, at 239, 253 . . . 451 , 478 . . . etc. The fact that the number n must be varied as above results in disadvantages that the respeq ive sampling numbers of the musical-tone-waveform memory circuits of the musical-tone waveform forming circuits 3*a*-1, 3*a*-2 . . . 3*a*-n must be differentiated from one another and that these must be numerous. Thus, as noted above, manufacture and adjustment thereof is relatively troublesome. These troubles are avoided by the circuit of the invention which will be explained next below.

Figure 3:
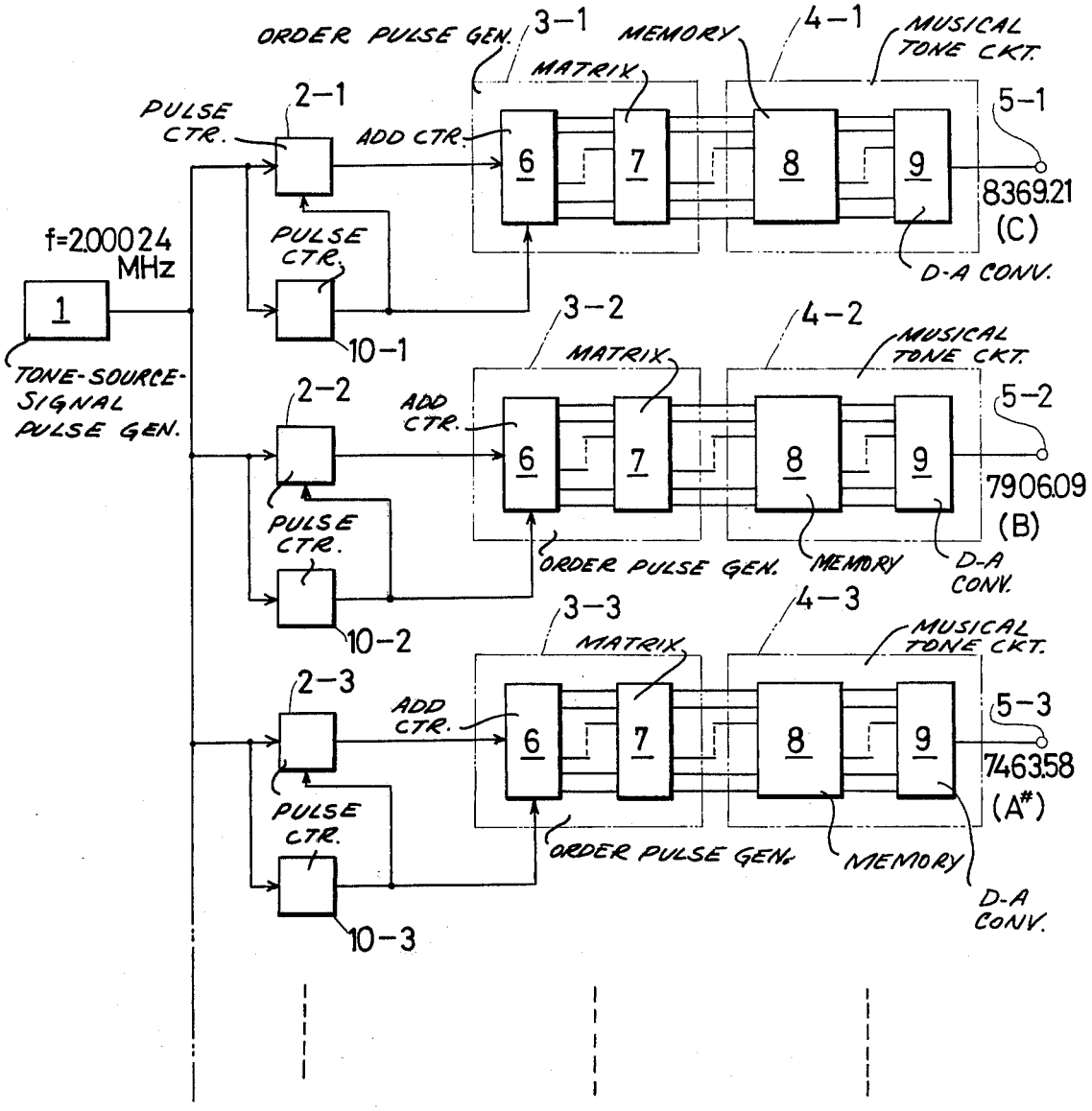
FIG. 3 is a block diagram showing an example of an electronic musical instrument in accordance with one embodiment of this invention.

In FIG. 3, component 1 is a tone-source-signal pulse generator, components 2-1, 2-2 . . . 2-n are first pulse-counter circuits connected in parallel to the output terminal of the tone-source-signal pulse generator 1, and components 3-1, 3-2 . . . 3-n are order pulse generators connected to the output sides of respective of the first pulse-counter circuits 2-1, 2-2 . . . 2-n. Each of these generators 3-1, 3-2 . . . 3-n is so arranged that input pulses are decoded thereby to produce order pulses in order at its output terminals. Components 4-1, 4-2 . . . 4-n are musical-tone waveform forming circuits connected to the output sides of respective of order pulse generators 3-1, 3-2 . . . 3-n, and each of these circuits 4-1, 4-2 . . . 4-n is so constructed and arranged that one musical-tone waveform corresponding to previously set values is formed by one cycle of the aforementioned order pulses. Components 5-1, 5-2 . . . 5-*n* are output terminals of the musical-tone waveform forming circuits 4-1, 4-2 . . . 4-*n*.

Each order pulse generators 3-1, 3-2 . . . 3-*n* comprises an address counter 6 and a matrix circuit 7 in almost the same manner as in the above-described conventional instrument, but is different therefrom in that the number of component parts thereof is small and the number of the output terminals thereof is small and may be about from 10 to 40 in number.

Each musical-tone waveform forming circuits 4-1, 4-2 . . . 4-n comprises a musical-tone-waveform memory circuit 8 and a digital-to-analog converter 9 in almost the same manner as in the foregoing conventional instrument, but is different therefrom in that the number of component parts thereof is small and the sampling number is small such as about from 10 to 40.

Assuming that the sampling number of each musical-tone-waveform memory circuit 8 is 10, the order pulse generators 3-1, 3-2 . . . 3-*n* can be adequate with ten output terminals for the number of order pulses of 10. Thus, by one cycle of order pulses decoded by each order pulse generator 3-1, 3-2 . . . 3*n* (that is, by ten pulses), one musical-tone-signal can be obtained from each output terminal 5-1, 5-2 . . . 5-*n* of each tone waveform forming circuit 4-1, 4-2 . . . 4-*n*. This is equivalent to the frequency-dividing ratio's being 10.

Assuming that the oscillation frequency f of the tone-source-signal pulse generator 1 is 2.00024 MHz and frequency- dividing ratio x of the first pulse-counter circuit 2-1 is 23.9, and, since the frequency-dividing ratio of the musical-tone waveform forming circuit 4-2 is 10 as mentioned above, the whole frequency-dividing ratio n becomes $10 \times 23.9 = 239$. A musical-tone signal of the correct frequency of 8369.21 Hz as shown in the following Table will be obtained from the output terminal 5-1 of the musical-tone waveform forming circuit 4-1.

If, further, the frequency-dividing ratio *x* of the first pulse-counter circuit 2-2 is 25.3, since the frequency-dividing ratio of the musical-tone waveform forming circuit 4-2 is 10 as mentioned above, the whole frequency-dividing ratio becomes 253. A musical-tone signal of the correct frequency of 7906.09 Hz will be obtained from the output terminal 5-2 of the circuit 4-2.

The above and the rest of the tone signals are as shown in the following Table.

TABLE f = 2.00024 MHz

| Frequency-dividing ratio | Correct output frequency | Frequency-dividing ratio of first pulse counter circuit | Frequency-dividing ratio of tone wave-form forming circuit | Frequency obtained by first pulse counter circuit and tone waveform forming circuit | Error % |
|---|---|---|---|---|---|
| 239 | 8369.21 | 24 | 10 | 8334.34 | 0.4 |
| 253 | 7906.09 | 26 | " | 7693.23 | 2.3 |
| 268 | 7463.58 | 27 | " | 7408.29 | 0.7 |
| 284 | 7043.10 | 29 | " | 6897.37 | 2.1 |

TABLE-continued f = 2.00024 MHz

| Frequency-dividing ratio | Correct output frequency | Frequency-dividing ratio of first pulse counter circuit | Frequency-dividing ratio of tone waveform forming circuit | Frequency obtained by first pulse counter circuit and tone waveform forming circuit | Error % |
|---|---|---|---|---|---|
| 301 | 6645.32 | 31 | " | 6452.38 | 3.0 |
| 319 | 6270.34 | 32 | " | 6250.75 | 0.3 |
| 338 | 5917.87 | 34 | " | 5883.58 | 0.6 |
| 358 | 5587.26 | 36 | " | 5556.22 | 0.6 |
| 379 | 5277.66 | 38 | " | 5263.78 | 0.3 |
| 402 | 4975.72 | 41 | " | 4878.63 | 2.0 |
| 426 | 4695.40 | 43 | " | 4651.72 | 1.0 |
| 451 | 4435.12 | 46 | " | 4348.34 | 2.0 |

However, it is impossible to generate exactly respective pulses with frequency-dividing ratios of 23.9, 25.3 . . . at the first pulse-counter circuits 2-1, 2-2 . . . 2-n. Accordingly, it can be considered that the frequency-dividing ratios are set to be 24, 26, 27 . . . as shown in the above Table. However, in this case, because the frequency-dividing ratio of each tone waveform forming circuit 4-1, 4-2 . . . 4-n is 10, the respective whole frequency-dividing ratios become 240, 260, 270 . . . etc. The resultant frequencies have errors of from 0.3 to 3.0% in relation to the correct frequencies as shown in the above Table. This is not suitable with respect to the generation of musical tones.

As shown in FIG. 3, it can be so arranged that the first pulse-counter circuits 2-1, 2-2 . . . 2-n have provided, in parallel therewith, respective second pulse-counter circuits 10-1, 10-2 . . . **10-*n* such that respective output pulses of the frequency-dividing ratios 239, 253, 268 . . . may be generated by circuits 10-1, 10-2 . . . 10-*n* and it is so arranged that each first pulse-counter circuit 2-1, 2-2 . . . 2-*n* and each order pulse generator 3-1, 3-2 . . . 3-*n*** are reset by the output pulses of the second pulse counters.

Figure 4:
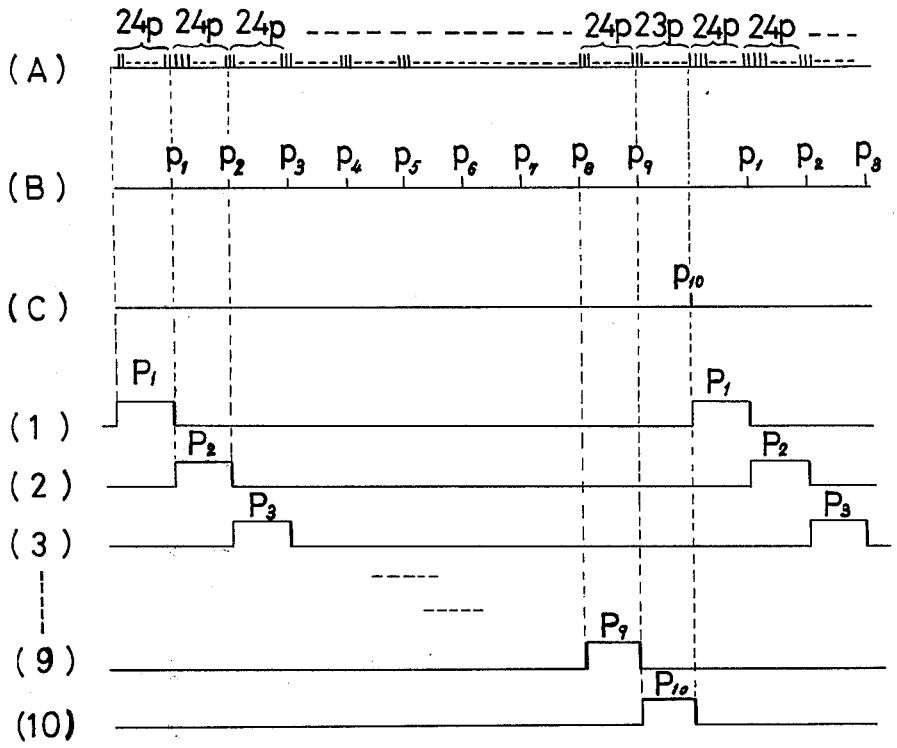
FIG. 4 is a diagram for explaining the operation of the same.

An output signal comprising a series of pulses generated in succession, as shown in FIG. 4(A), from the tone-source-signal pulse generator 1 is applied as an input to the first pulse-counter circuit 2-1. When twenty-four input pulses are counted thereby, one output pulse is taken out therefrom as shown in FIG. 4(B). During the time that the 24 input pulses are being counted, the first order pulse P1 is generated as shown in FIG. 4(1) from the first output terminal of the order pulse generator 3-1. The first sampling of the musical-tone-waveform memory circuit 8 in the musical-tone waveform forming circuit 4-1 is read out by this first order pulse P1. Digital signals corresponding to the set values thereof are generated and these are converted into an analog signal by the digital-to-analog converter.

Thus, the output signal of the tone-source-signal pulse generator 1 is successively counted every twenty-four pulses by the first pulse-counter circuit 2-1 to generate nine output pulses of from p1 to p9, whereby the order pulses P1-P2 from the first order to the 9th order are generated as shown in FIG. 4(1) . . . (9) and thereby the first to ninth sampling are read out. When the first to ninth samplings are read out as above, the input signal is 216 (24 × 9) as to the number of pulses. If it is now supposed that the reading out is continued from the first sampling to the tenth sampling, the number of the input pulses to the first pulse-counter circuit 2-1 would be 240 and thereby one musical-tone waveform would be obtained at the output terminal 5-1. As will be clear from the foregoing explanation, this means 240 in frequency-dividing ratio and there is caused an error in musical-tone-signal frequency as compared with 239 which is the correct frequency-dividing ratio.

To improve in this situation, it is so arranged that, after the p1-p9 pulses, (namely, one pulse per 24 input pulses) are generated by the first pulse-counter circuit 2-1, 239 input pulses are counted by the second pulse counter circuit 10-1 which then generates the tenth pulse p10 as shown in FIG. 4(C). The first pulse-counter circuit 2-1 and the order pulse generator 3-1 are reset by the pulse p10. At the time interval between the pulses P9 and P10, the tenth order pulse P10 is generated to read out the tenth sampling, whereby one musical-tone waveform can be obtained by 239 input pulses. Then, the first pulse-counter circuit 2-1 begins to count anew the input pulses and the foregoing sequence is repeated. Consequently, a musical-tone signal of correct frequency with the frequency-dividing ratio of 239 can be obtained.

The time interval for reading out the tenth sampling is shorter than the time interval for reading out any one of the other samplings, but this can be previously recognized. Accordingly, a tone signal of desired waveform can be obtained by taking this into consideration in setting the sampling.

If, further, it is now determined that the frequency-dividing ratio of the first counter circuit 2-2 is 26 and also that of the second pulse-counter circuit 10-2 is 253, together with the condition that the frequency-dividing ratio of the musical-tone-waveform memory circuit 8 is 10, the whole frequency-dividing ratio becomes 253. Thereby a correct musical-tone signal frequency can be obtained.

Thus, if the frequency-dividing ratios n of the second pulse-counter circuits 10-1, 10-2 . . . **10-*n*** are so chosen respectively to be those shown in the extreme left column of the above Table, the frequency-dividing ratio *x* of each first pulse-counter circuit 2-1, 2-2 . . . **2-*n* can be made an integral number and also the sampling number in each musical-tone-waveform memory circuit 8 can be made a constant number of 10.**

In case the oscillation frequency of the tone-source-signal pulse generator 1 is 2.00024 MHz, the sampling number can be revised up to 16. Further, if any sampling number extending from 17 to 40 is intended to be set, this setting becomes possible by increasing the frequency of the pulse generator 1 to two or three times 2.00024 MHz.

Thus, according to this invention, a first pulse-counter circuit and a second pulse-counter circuit are provided in each of the divergent circuits connected between the output terminal of the tone-source-signal pulse generator and respective order pulse generators, so that an error resulting from the output pulses of the first pulse-counter circuit can be eliminated by output pulses of the second pulse-counter circuit. Thus, all the musical-tone-waveform memory circuits connected to the output sides of the order pulse generators can be simplified in construction such that each sampling number thereof is, for instance, only 20. In accordance therewith, the order pulse generators can be also simplified in construction and correct tone-signal frequencies can be precisely obtained.

What is claimed is:

1. An electronic musical instrument comprising a plurality of musical-tone waveform generating means for generating musical tones, a plurality of order pulse generating means for generating order pulses to sample respective of the musical-tone waveform generating means, tone-source-signal generating means for generating a tone-source-signal, and a plurality of counting means coupling said tone-source-signal generating means to respective of said order pulse generating means for dividing the frequency of said tone-source-signal, said counting means including count modifying means to provide for perfecting tone generation, said counting means further including first and second pulse counters each coupled to said tone-source-signal generating means, said first counter being coupled to and supplying count signals to the associated order pulse generating means, said second counter being coupled to and adapted to reset said first counter, the first and second pulse counters respectively dividing the tone-source-signal by $1/x$ and $1/n$ with the relation of $O<x<n$ with $x$ and $n$ being integral numbers.

2. An instrument as claimed in claim 1 wherein each said order pulse generator means includes an address counter and matrix coupled in series to the associated musical-tone waveform generating means and the second counter of the associated counting means is connected to and adapted to reset said address counter.

3. An instrument as claimed in claim 2 wherein each said musical-tone waveform generating means includes a memory and digital-to-analog converter coupled in series to generate a musical tone and said memory is connected to the matrix of the associated order pulse generating means.

4. An instrument as claimed in claim 2 wherein each musical-tone waveform generating means has a sampling number of 10 to 40.

* * * * *